United States Patent [19]

Babish et al.

[11] 4,178,134

[45] Dec. 11, 1979

[54] ENGINE COOLANT SYSTEM FLUSH ATTACHMENT FOR COOLANT HOSE

[75] Inventors: John A. Babish, Glendora; Larry K. Arnot, Duarte; Douglas C. Appel, Glendora, all of Calif.

[73] Assignee: Wynn Oil Company, Fullerton, Calif.

[21] Appl. No.: 867,527

[22] Filed: Jan. 6, 1978

[51] Int. Cl.[2] ..... F01P 11/06

[52] U.S. Cl. ..... 417/181; 134/102; 134/169 A; 261/DIG. 75; 165/95; 239/428.5; 123/41.45; 137/604

[58] Field of Search ..... 134/102, 169 A; 261/DIG. 75; 165/95; 239/428.5, DIG. 22; 417/181, 167; 123/41.45; 137/218, 604

[56] References Cited

U.S. PATENT DOCUMENTS

| | | | |
|---|---|---|---|
| 1,939,836 | 12/1933 | Tolfree | 134/102 |
| 2,052,622 | 9/1936 | Hale | 134/102 |
| 2,222,516 | 11/1940 | Powell et al. | 134/169 A |
| 2,244,159 | 6/1941 | Hunter | 134/102 |
| 2,248,731 | 7/1941 | Young | 137/604 |
| 2,328,414 | 8/1943 | Beyer | 261/DIG. 75 |
| 2,366,969 | 1/1945 | Kiggins | 134/102 |
| 2,381,589 | 8/1945 | Hayes | 417/181 |
| 2,414,260 | 1/1947 | Hunter | 261/DIG. 15 |
| 3,180,759 | 4/1965 | Falk | 134/102 |
| 3,470,826 | 10/1969 | Foulds | 137/604 |
| 3,853,784 | 12/1974 | Rogers | 137/604 |
| 4,083,399 | 4/1978 | Babish et al. | 134/169 A |

FOREIGN PATENT DOCUMENTS

| | | | |
|---|---|---|---|
| 988654 | 4/1965 | United Kingdom | 134/102 |

*Primary Examiner*—Charles J. Myhre
*Assistant Examiner*—Jeffrey L. Yates
*Attorney, Agent, or Firm*—William W. Haefliger

[57] ABSTRACT

A flush attachment for a coolant hose accommodates gas or air induction to mix with a pressurized stream of cleaning liquid for efficient scavenging of rust or scale from machinery cooling systems. The construction of the attachment also protects against over pressurization and possible bursting.

13 Claims, 7 Drawing Figures

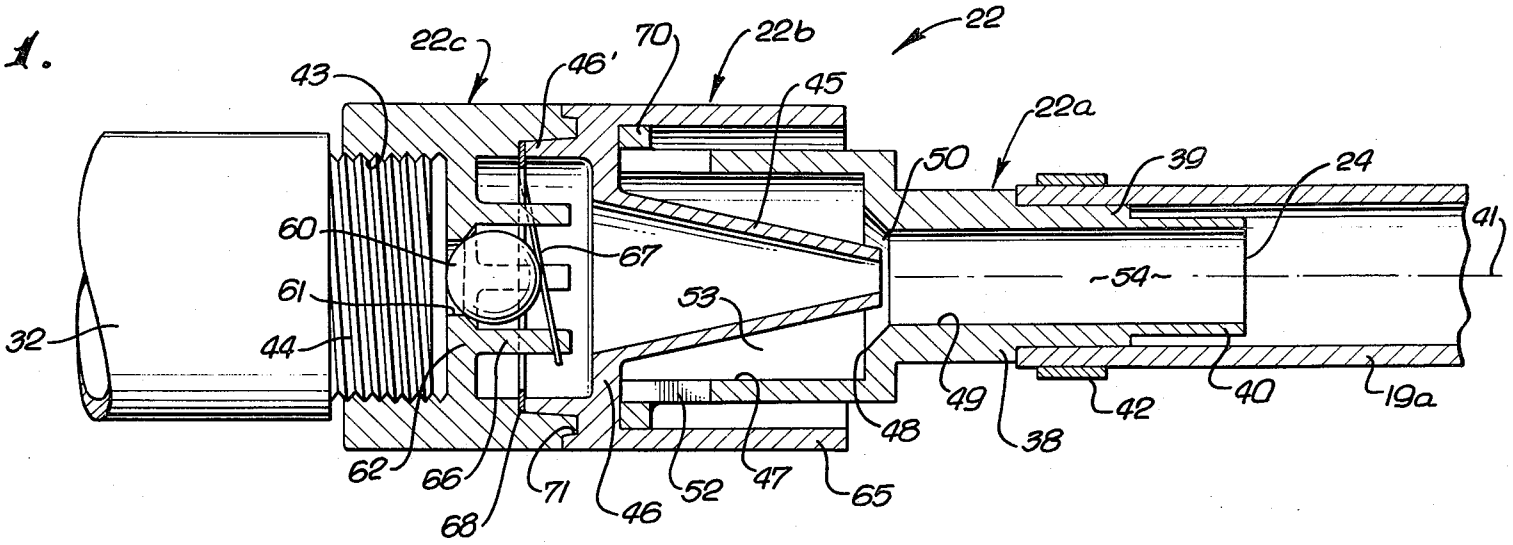
FIG. 1.
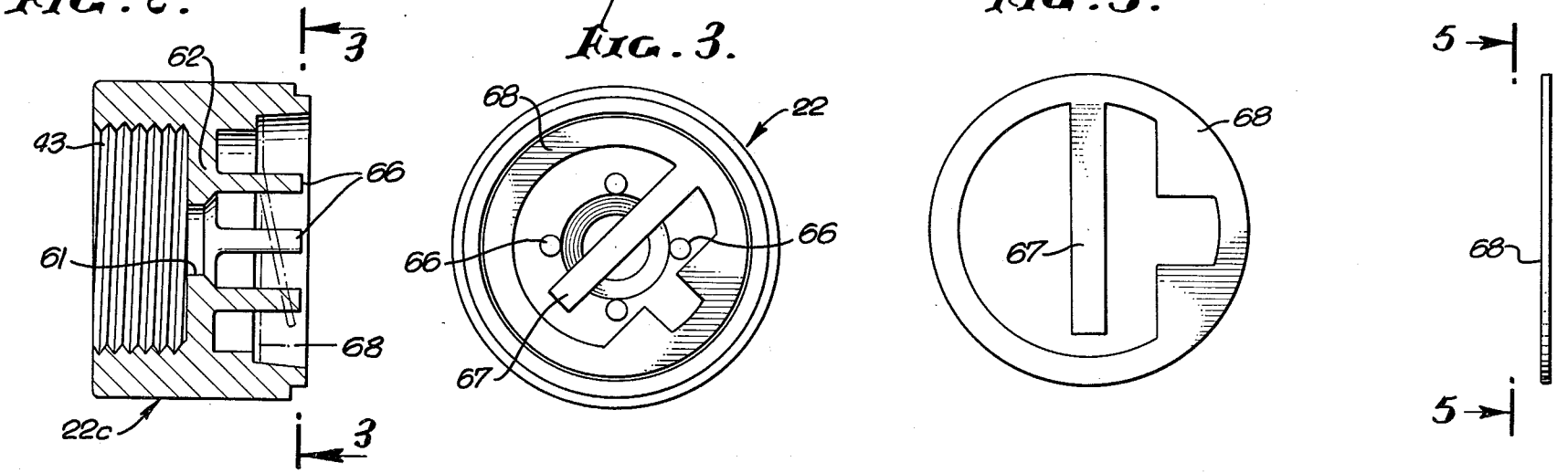
FIG. 4.
FIG. 5.
FIG. 3.
FIG. 2.

ENGINE COOLANT SYSTEM FLUSH ATTACHMENT FOR COOLANT HOSE

BACKGROUND OF THE INVENTION

This invention relates generally to flushing of liquid cooling system in machinery, as for example internal combustion engine cooling systems. More particularly, it concerns simple, portable apparatus usable as for example by a vehicle owner or driver.

Studies show that over-heating is a major cause of vehicle breakdowns on highways. Engine cooling systems must operate efficiently at all times to avoid costly repairs that result from excessive temperature. In this regard, cooling systems contaminated by rust, scale build-up and sludge cannot provide adequate heat transfer and cooling system efficiency; in addition, thermostats fail to open, hoses deteriorate, impellers bind or break-off, and engine blocks can become distorted or crack. Accordingly, there is a need for efficient engine cooling system flushing methods and apparatus; however, those with which we are familiar lack the unusually advantageous combinations of structure, modes of operation and results as are now afforded by the present invention.

While flushing apparatus has been provided in the past, it is normally large, complex and costly, whereby a vehicle driver or owner cannot himself carry out the cooling system flushing operation as respects the engine and cooling system of his automobile, but he must have the work done at a repair shop or service station. This is inconvenient, costly and time consuming. Therefore, a need exists for a device which is small sized, may be carried by the vehicle owner or driver, and which is inexpensive.

SUMMARY OF THE INVENTION

It is a major object of the invention to provide a simple device of the character described, which will overcome the prior requirement for large scale flushing equipment normally only found in repair shops or service stations. It is a further object of the invention to incorporate air induction in such a device, to mix with pressurized cleaning liquid for more efficient scavenging of rust and scale from machinery cooling systems, and in a reverse flush mode or modes. It is a further object of the invention to incorporate a pressure release system to protect the machinery cooling system from over pressurization and possible bursting, as will be seen.

Basically, the device of the invention is constructed to be used in combination with a machine cooling system and to be connectible to a coolant duct of that system. It comprises:

(a) means coupled with that duct to supply a controlled pressurized flow mixture of cleaning liquid and gas bubbles, (b) such means includes a generally tubular body having a high pressure liquid inlet at one end thereof and a low pressure flow mixture outlet at the opposite end thereof, (c) and such means also includes a gas passage associated with said body to supply a side stream of gas into the body to mix with the liquid flowing to the said outlet, (d) and there being an excess pressure release passage associated with said body to release liquid pressure above a predetermined amount.

The device itself basically comprises, more specifically, (a) body means having an outlet portion coupled to an end of the duct, (b) the body means having an inlet portion to receive high pressurized fluid from a flush fluid source line for flow into the duct, (c) aspirating means associated with said body means to aspirate air into the low pressurized fluid flow into the duct, (d) check valve means associated with said body means to pass the pressurized flow in the body to the duct and to block reverse flow from the duct into the source line, and (e) pressure release means associated with said body means to provide a release for excessive pressure in the duct above a predetermined level.

As will appear, the body means may comprise multiple telescopically interfitting sections, one of which defines the outlet portion and multiple stub ducts to selectively interfit coolant system ducts of different sizes; the aspirating means is located between the check valve means and the outlet portion, and may advantageously comprise a venturi duct tapering toward the outlet portion and extending into a reduced diameter body bore section, with clearance; the body may define side inlets to pass air into a pressure chamber about the venturi duct, for induction into the lowered pressure liquid flow from the venturi duct; the check valve means may include a ball valve, an annular seat for same, a cage for the ball valve, and a flat spring to lightly urge the valve toward seated position, whereby it will close in the event of reverse flow through the venturi tube, preventing contamination of the supply; the side inlets also serve to relieve pressure in the event of such reverse flow; the side inlets also serving as a means to release pressure in the duct above a predetermined level; and the whole of the above are incorporated in a simple, small size unit of telescopically interfitting construction.

These and other objects and advantages of the invention, as well as the details of an illustrative embodiment, will be more fully understood from the following description and drawings, in which:

DRAWING DESCRIPTION

FIG. 1 is a side elevation, in section, showing apparatus incorporating the invention;

FIG. 2 is a side elevation in section, of a check valve ball cage, as seen in FIG. 1;

FIG. 3 is an end elevation on lines 3—3 of FIG. 2;

FIG. 4 is an enlarged side elevation of a check valve spring used in FIG. 1;

FIG. 5 is a frontal elevation of the FIG. 3 spring, taken on lines 4—4 of FIG. 3.

DETAILED DESCRIPTION

Figure 6:
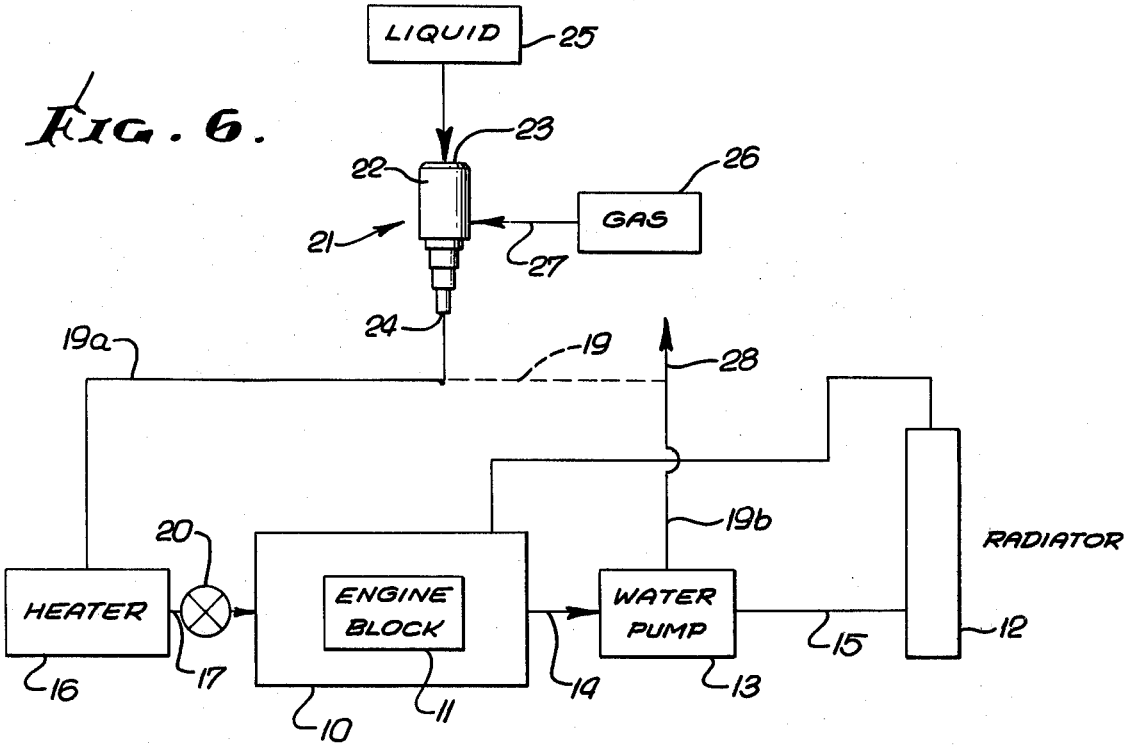
FIG. 6 is a flow diagram showing operation of the FIG. 1 apparatus during a reverse flush through the heater core, engine block and water pump.

In accordance with the invention, a machine cooling system is to be supplied with a controlled pressurized flow mixture of cleaning liquid and gas bubbles. As seen in FIG. 6, the machine cooling system is by way of example, shown as including an internal combustion engine cooling system. Thus, an engine 10 has a block 11, defining coolant passages through which liquid coolant (such as water) is adapted to pass; a radiator 12; and a liquid coolant (i.e. water for example) pump 13 connected to pump coolant between the block and radiator, as via lines 14 and 15. Also shown, is a heater 16 (to heat a vehicle for example) connected at 17 with the block 11. Typically, the water pump may be connected with the heater via a hose; however, the latter is shown as cut at 19 so that the hose is formed as sections 19*a* and 19*b*. A valve is shown at 20 in hose 17.

Figure 7:
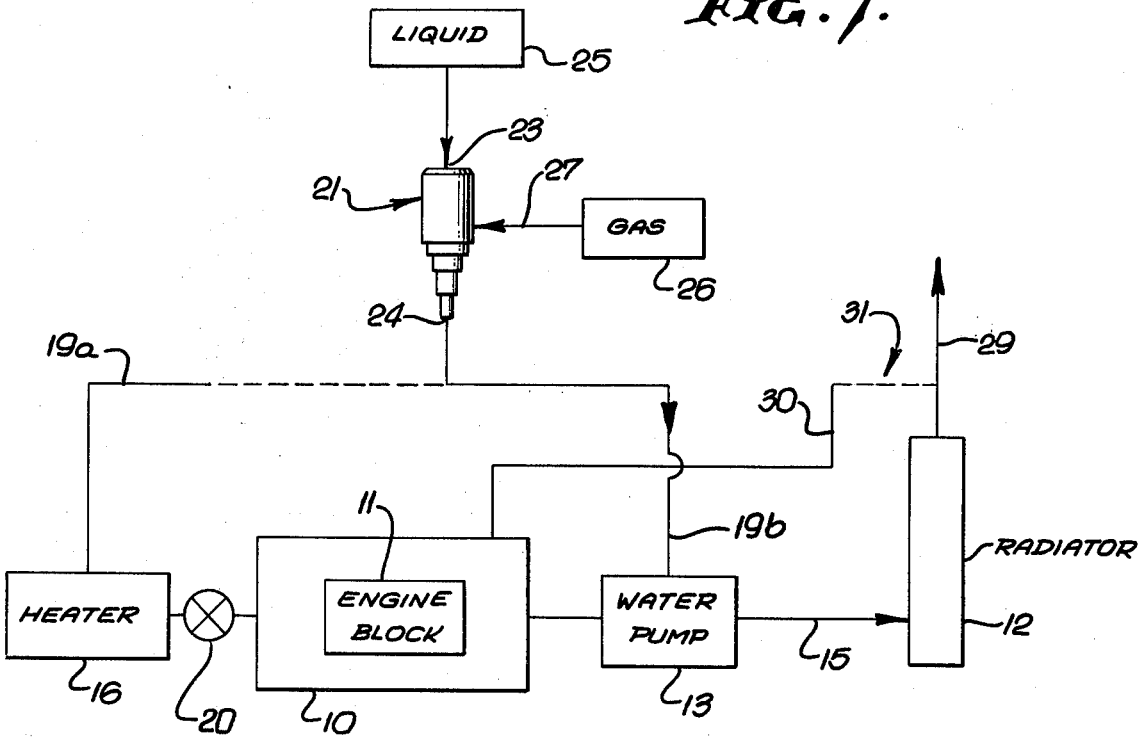
FIG. 7 is a flow diagram showing operation of the FIG. 1 apparatus during a reverse flush through the radiator core.

In accordance with one aspect of the invention, means indicated at 21 is connected with the hose or duct 19*a* in FIG. 6, or alternatively with the hose or duct 19*b* in FIG. 7, to supply a controlled pressurized flow mixture of cleaning liquid and gas bubbles, such means comprising a generally tubular body 22 having a high pressure liquid inlet 23 at one end, and a low pressure flow mixture outlet at its opposite end 24. Such means also includes a gas passage associated with the body to supply a side stream of gas into the body to mix with the pressurized liquid flowing to the outlet 24. A source of high pressurized liquid is shown schematically at 25, such liquid commonly consisting of water at a pressure of between 15 and 100 psi. The source 25 may be considered to include a pressure regulator, if desired. However, such a regulator is not necessary since the design configuration of the body allows for the release of excess liquid pressure when machinery cooling system safe working pressure is exceeded, such safe pressure normally considered to be between 10 psi and 20 psi; the excess pressure is released at point 27 in a reverse flow through the gas passage. The source of gas, commonly consisting of air, is indicated schematically at 26 introducing the side stream at 27 to the body; and in accordance with a further feature of the invention, the source may comprise an air aspirator built into the body 22, as for example in the manner to be described.

If FIG. 6, the flow mix passes reversely through the hose section 19*a*, heater core 16, engine block 11, and water pump 13, to be vented to waste at 28. In FIG. 7, the flow mix passes reversely through the hose section 19*b*, water pump 13, and radiator 12 to vent at 29. In this case, the hose 30 normally connecting the block and radiator is disconnected at 31. The gas or air bubbles collapse and expand to scrub the interior of the components passing the flow, to efficiently remove scale, rust, and other deposits from the system being flushed. If desired, chemical cleaner can be added to the radiator prior to flushing. Note that unit or means 21 is fully portable and easily connected in series with the hose or duct sections 19*a* and 19*b*, as desired, whereby a user may readily and easily flush his own machinery, such as internal combustion engine cooling and heating system components.

Turning to FIG. 1, an unusually advantageous example of unit 21 is shown in greater detail. It includes body 22 defined by three body sections 22*a*, 22*b*, and 22*c* interfitting in telescopic relation. Such body sections may be considered to define a compact, efficient combination that includes:

(a) an outlet portion (22*a*) coupled to an end of the duct (19*a* for example)

(b) an inlet portion (22*c*) to receive pressurized fluid from a flush liquid source line 32, for flow to duct 19*a*, (c) aspirating means associated with said body means to aspirate air into the pressurized fluid flow into the duct, (d) an excess pressure release port associated with said body to release pressure in duct 22*a* above a predetermined level, (e) an anti-siphon release port associated with said body to prevent backflow of flush liquid from the duct into the source line, and (f) check valve means associated with the body means to pass the pressurized flow in the body to the duct and to block reverse flow from the duct into the source line.

More specifically, the body section 22*a* forms at least one, and preferably multiple generally cylindrical tubular stub shafts, as for example at 38, 39 and 40 projecting freely endwise in the direction of axis 41. Such stubs have progressively decreasing outer diameter as shown, so that hose or duct ends of different bore sizes may be selectively clamped to the stubs of closest matching diameter. One such clamp is seen at 42, clamping hose 19*a* to stub 39. The body inlet section 22*c* typically defines an internal thread 43 to couple to a matching thread 44 at the terminal of the pressurized liquid source line 32.

The check valve means, and combination aspirating, anti-siphon and pressure release means are advantageously located in sequence between thread 43 and the stub 38. In this regard, the aspirating, and combination anti-siphon and pressure release means comprises a frusto-conical venturi duct 45 carried by an internal flange 46 on the body section 22*b*. Duct 45 tapers rightwardly in FIG. 1 toward the outlet portion 24, and extends within relatively large bore 47 of section 22*a* past step shoulder 48 and partly into reduce diameter bore 49 formed by section 22*a*. Annular clearance is provided at 50 between the tip of the duct 45 and the chamfered entrance to bore 49, to provide for air flow into the cleaning liquid flow issuing from duct 45, the velocity of such flow having been increased in duct 45 with reduction in pressure for effecting the aspiration of air into the flow. For that purpose, the body section 22*a* is provided with multiple side inlets 52 to pass air from the exterior into the plenum chamber 53 about venturi duct 45, from which air flows through clearance 50 at increased velocity to mix with high speed cleaning liquid in mixing chamber 54. Air bubbles thus formed in the flow are used to scavenge scale, rust and other deposits, as previously described.

The check valve means may advantageously comprise a light weight ball valve (as for example plastic) 60, and an annular seat 61 for that valve. The seat is formed on an interior annular flange 62 integral with body section 22*c*, the ball being closer to the aspirating means than the seat, whereby it normally passes the flow to outlet 24, but closes against the seat to block reverse flow, preventing contamination of the water or other liquid supply. In the event of such reverse flow, inlets 52 will pass liquid from chambers 54 and 53 to the exterior, relieving built-up pressure. Note that the skirt 65 of section 22*b* extends over the inlets in protective relation.

A cage for the ball 60 is advantageously formed by four legs 66 which are circularly spaced about axis 41 and which extend axially from flange 62 toward flange 46.

A flat spring 67 yieldably urges the ball toward its seat, and may be carried by a flat ring 68 as better seen in FIGS. 4 and 5. Ring 68 is seated against flange 46' so that the flat spring 67 extends between two of the legs 66, to bear against the ball valve.

Note the telescopic interfit of the sections 22*a* and 22*b* at 70, and the telescopic interfit of the sections 22*b* and 22*c* at 71.

The unit of FIG. 1 is also usable as a low volume high pressure nozzle for washing lawn care equipment, sidewalks, patios, and other areas.

Advantages of the described unit include the following:

1. Use of air aspiration provides air bubbles in the pressurized water flow to assist in dislodging and removing of cooling system contaminants;

2. Built-up pressure release, via clearance 50, plenum 53 and ports 52, virtually eliminates any possibility of over-pressurization, even under extremely high water pressure supply conditions, as encountered in certain municipal water supply systems; normally, a vehicle engine cooling system should not be subjcted to pressures in excess of 15–20 pounds.

3. The device may be employed for diagnostic purposes; for example, excessive water flow outward from a port 52, in FIG. 6 mode, indicates a possibly blocked heater core, a heater valve in OFF position, or other restriction in the cooling system.

4. The advantages of the check valve, anti-siphon design, as described.

5. Adaptation of the unit to different heater hose sizes.

We claim:

1. In combination with an engine cooling fluid duct,
(a) body means having an outlet portion coupled to an end of the duct,
(b) the body means having an inlet portion to receive pressurized fluid from a flush fluid source line for flow into the duct,
(c) aspirating means including a forwardly tapering duct portion associated with said body means to aspirate air into the pressurized fluid flow into the duct,
(d) check valve means associated with said body means to pass the pressurized flow generally forwardly in the body to the duct and to block reverse flow from the duct into the source line, and
(e) pressure release means associated with said body means and spaced generally outwardly of said duct portion to release excessive pressure in the duct at a predetermined pressure level,
(f) said check valve means located generally in alignment with, and directly rearwardly of the forwardly tapering duct portion.

2. The combination of claim 1 wherein said body means outlet portion forms at least one generally cylindrical stub projecting freely endwise of the body means.

3. The combination of claim 1 wherein said body means outlet portion forms multiple generally cylindrical stubs projecting freely endwise of the body means, said generally cylindrical stubs respectively having progressively decreasing outer diameters.

4. The combination of claim 2 wherein the body means inlet portion defines a thread to coupled to a mating thread at the terminal of said line.

5. The combination of claim 1 wherein said aspirating means duct portion comprises a frusto-conical venturi duct tapering toward said outlet portion, and extending into a reduced diameter body bore section with clearance, the body means having side inlet means communicating with the exterior of said frusto-conical duct upstream from said reduced bore.

6. The combination of claim 1 wherein said check valve means comprises a ball valve an annular seat for said valve, the ball being closer to the aspirating means than the seat, a cage in which the ball is received, and a flat spring yieldably urging the ball toward the seat, the ball, seat, cage and flat spring located interiorly of said body means.

7. The combination of claim 1 wherein said duct is in series communication with a heater heat transfer passage which is in turn in series communication with a heat transfer passage defined by the engine block.

8. The combination of claim 1 wherein said duct is in series communication with a coolant pump driven by the engine, the pump in series communication with a coolant passage defined by a heat radiator associated with the engine.

9. The combination of claim 1 including an internal combustion engine cooling system that includes an engine coolant passage and a coolant pump connected with said passage, said duct operatively connected in series with said passage to pass the pressurized flow toward said engine coolant passage and then toward said pump.

10. The combination of claim 9 wherein said system includes a vehicle heater having a coolant passage connected in series between said duct and said engine coolant passage.

11. The combination of claim 1 including an internal combustion engine cooling system that includes a liquid coolant heat radiator, and a liquid coolant pump connected in series between said duct and said radiator to pass the pressurized flow reversely through the radiator via said pump.

12. In combination with an engine cooling fluid duct,
(a) body means having an outlet portion coupled to an end of the duct,
(b) the body means having an inlet portion to receive pressurized fluid from a flush fluid source line for flow into the duct,
(c) aspirating means associated with said body means to aspirate air into the pressurized fluid flow into the duct,
(d) check valve means associated with said body means to pass the pressurized flow in the body to the duct and to block reverse flow from the duct into the source line, and
(e) pressure release means associated with said body means to release excessive pressure in the duct at a predetermined pressure level,
(f) said aspirating means located between said check valve means and said outlet portion coupled to the duct,
(g) said check valve means comprising a ball valve, an annular seat for said valve, the ball being closer to the aspirating means than the seat, a cage in which the ball is received, and a flat spring yieldably urging the ball toward the seat, the ball, seat, cage and flat spring located interiorly of said body means,
(h) the body means including a first section carrying a check valve component, a second section carrying the venturi duct, and a third section defining multiple outlet stub ducts of different diameter, pairs of said sections having telescopic interconnection.

13. For combination with a fluid duct, apparatus comprising (a) body means having an outlet portion coupled to an end of the duct, (b) the body means having an inlet portion to receive pressurized fluid from a fluid source line for flow into the duct, (c) aspirating means including a forwardly tapering duct portion associated with said body means to aspirate air into the pressurized fluid flow into the duct, (d) check valve means associated with said body means to pass the pressurized flow generally forwardly in the body of the duct and to block reverse flow from the duct into the source line, and (e) pressure release means associated with said body means and spaced generally outwardly of said duct portion to release excessive pressure in the duct at a predetermined pressure level, (f) said check valve means located generally in alignment with, and directly rearwardly of the forwardly tapering duct portion.

* * * * *